United States Patent [19]

Hässler et al.

[11] 3,957,453

[45] May 18, 1976

[54] SINTERED METAL POWDER ELECTRIC CONTACT MATERIAL

[75] Inventors: Heinrich Hässler, Wendelstein; Hans-Joachim Lippmann, Boxdorf, both of Germany

[73] Assignee: Siemens Aktiengesellschaft, Munich, Germany

[22] Filed: July 23, 1973

[21] Appl. No.: 381,516

[30] Foreign Application Priority Data

Aug. 17, 1972 Germany ..... 2240493

[52] U.S. Cl. ..... 29/182.1; 252/512; 252/513; 252/514; 252/515

[51] Int. Cl.[2] ..... B22F 3/00

[58] Field of Search ..... 75/200, 208; 29/182.1; 252/512, 513, 514, 515

[56] References Cited

UNITED STATES PATENTS

| | | | |
|---|---|---|---|
| 2,851,381 | 9/1958 | Hoyer | 29/182.1 |
| 3,125,441 | 3/1964 | Lafferty | 29/182.1 |
| 3,353,931 | 11/1967 | Zdanuk et al. | 29/182.1 |
| 3,423,203 | 1/1969 | Zdanuk et al. | 29/182.1 |
| 3,489,530 | 1/1970 | Schreiner | 29/182.1 |
| 3,779,715 | 12/1973 | Wendler et al. | 29/182.1 |

FOREIGN PATENTS OR APPLICATIONS

| | | | |
|---|---|---|---|
| 556,623 | 4/1958 | Canada | 29/182.1 |
| 836,749 | 6/1960 | United Kingdom | 29/182.1 |
| 148,533 | 9/1921 | United Kingdom | 29/182.1 |
| 1,079,013 | 8/1967 | United Kingdom | |

*Primary Examiner*—Leland A. Sebastian
*Assistant Examiner*—B. Hunt
*Attorney, Agent, or Firm*—Kenyon & Kenyon Reilly Carr & Chapin

[57] ABSTRACT

An electric contact material comprises a matrix formed by refractory metal powder particles having interbonding portions and defining pores infiltrated by a solidified molten metal impregnant. The interbonding portions are formed by a solidified molten alloy formed by the refractory metal and an alloying metal, and has a melting temperature above the impregnant's melting temperature. The alloying metal is present in an amount that is small relative to that of the refractory metal but which is effective for the formation of the interbonding portions by the alloy. The material may be made by cold molding the refractory metal powder particles and powder particles of the alloying metal, to form a compact which is then sintered without being under pressure. The interbonding alloy forms during the sintering, and when solidified, forms the interbonding portions between the particles defining the pores. By infiltration these portions are filled with the molten impregnating metal.

1 Claim, No Drawings

SINTERED METAL POWDER ELECTRIC CONTACT MATERIAL

BACKGROUND OF THE INVENTION

Powder metallurgy has been used to make electric contact materials. Refractory metals, by which is meant metals having a melting temperature above 1600°C, in powder form, may be molded into a compact which is sintered to form a porous matrix and which is infiltrated by molten metal having a composition intended to provide the desired properties. The resulting product is then used to make an electric contact.

The impregnating metal must have a lower melting temperature than that of the sintered matrix to avoid destruction of the latter during the infiltration step.

When intended for the contacts of vacuum switches, such a material must meet stringent requirements such as freedom from gas content, reliable operation while carrying large currents, such as 25 KA and higher, and low breakoff currents of less than 5A, an adequately low welding force such as less than 500N, and others. Resistance to destruction by burning must be sufficiently high, such switches being required to have a service life of more than 10,000 switching cycles under nominal current conditions, and approximately fifty direct short-circuit openings.

The prior art, exemplified by German published patent application No. 1,640,039, has proposed the use of chromium or cobalt for the sintered matrix, and which is impregnated with copper or silver. Chromium powder has the disadvantage that it is difficult to mold into a dimensionally stable compact suitable for sintering, even by molding under very high pressure. Cobalt has the disadvantage that because of its ductility powder particles of this metal deform under the pressure required to form it to a compact for sintering, resulting in a matrix having closed pores which cannot be satisfactorily infiltrated by the molten metal impregnant.

However, the above type of material has the advantage that the matrix provides good resistance to burn-off during contact operations under high electric currents, while the impregnant provides high electric conductivity. In fact, the burn-off involved is less than that which can be provided by either the matrix metal or the impregnating metal when used alone.

To obtain this advantage, it is necessary that the matrix retains its as-sintered physical structure after infiltration by the high conductivity impregnant. This is complicated by the fact that a relatively large pore matrix is desirable, such as obtained by using metal powder having a particle size of up to 150 microns, to facilitate the infiltration of the impregnating metal. This introduces the problem that the matrix may include poorly interbonded powder particles having relatively few and weak interbonding portions after the sintering, and if at the impregnating temperature there exists substantial solubility between the matrix metal and the impregnating metal, such interbonding portions may be dissolved during the infiltration of the impregnant with the result that the matrix powder particles of chromium or cobalt may appear as isolated or unbonded powder particles in the finished material.

SUMMARY OF THE INVENTION

An object of the present invention is to overcome such difficulties and to provide the described type of electric contact material improved at least to the extent that the matrix, even if made from coarse grained metal powder, has the powder particles firmly and strongly interbonded, is free from closed pores even if the matrix metal has malleable characteristics, and with the as-cast physical structure of the matrix fully retained after the infiltration or impregnating step.

According to the invention, a mixture is formed of a refractory metal powder and an alloying metal powder, the metals of the two powders being at least partially soluble in each other at sintering temperatures, the amount of the alloying powder which is a secondary component being small relative to that of the refractory metal powder which is a main component but effective to form with the latter an alloy having a higher melting temperature than the impregnant to be used and which when solidified bonds the refractory powder particles together. This mixture, while cold, is molded into a compact which is then sintered without the application of pressure. During the sintering, the two metal components alloy at least to some extent with the resulting alloy becoming molten from the sintering temperature to an extent firmly and strongly bonding the refractory powder particles together, after solidification of the alloy, and producing a sintered matrix having well-defined open pores. This matrix is then infiltrated with the molten metallic impregnant at a temperature below that of the alloy and, after cooling, provides the improved material.

This material has the refractory metal powder particles interbonded by the solidified molten alloy formed on the surfaces of the former, by the refractory metal and the alloying metal. The alloying metal is selected so that the interbonding alloy has a melting temperature above that of the melting temperature of the impregnant to be used. The alloying metal is present in an amount that is small relative to that of the refractory metal but is still effective for the formation of the necessary interbonding portions of the refractory metal particles. The as-sintered matrix's physical structure remains substantially unchanged by the infiltrated metallic metal impregnant, because of the strength of the interbonding portions.

The refractory characteristics of the refractory metal are not substantially altered because the alloying metal may be used in such a small amount, such as from 0.2 percent to not more than 15 percent by weight of the alloy. The alloying metal should be at least partially soluble in the refractory metal when the mixture of the metal particles are sintered.

DESCRIPTION OF THE PREFERRED EMBODIMENTS

In more detail, the refractory metal which is the metallic main component should have a melting temperature higher than 1600°C, the metallic alloying or secondary component should form an alloy with the refractory metal having a melting temperature higher than that of the metallic impregnant to be used, the matrix components should be at least partially soluble in each other at the sintering temperature used, and the amount of the alloying component should be small relative to that of the refractory metal component, as exemplified by being present within the range of from 0.2 to 15 percent by weight of the total.

The finished matrix should have its powder particles firmly interconnected by interbonding portions formed by the alloy when solidified after the sintering, these portions forming in effect bridges between the particles, and so that clearly defined open pores are formed.

Suitable refractory materials are chromium, zirconium and titanium.

If chromium is used as the refractory metal, suitable alloying metals are zirconium, iron, nickel, cobalt, titanium and manganese.

When zirconium is used, the alloying component may be chromium, cobalt, iron, nickel, titanium and manganese.

If the refractory metal component is titanium, suitable alloying metals are cobalt, iron, nickel and manganese.

In all cases suitable impregnants are copper, silver and the alloys consisting of copper-silver, copper-bismuth, cobalt-silver-bismuth, silver-bismuth, copper-tellurium and copper-silver-tellurium.

To make the new electric contact material, powders of the refractory and alloying metals are mixed and cold molded into a compact which without compression pressure, or at least any appreciable pressure, is sintered and thereafter permitted to cool to at least a degree solidifying the interbonding alloy between the powder particles. The molten impregnant is thereafter infiltrated into the pores of this compact. Generally speaking, prior art powder metallurgy techniques may be used although it should be noted that because of the cold molding to form the compact and because the latter is sintered without being under pressure, even if the refractory metal is malleable to a substantial degree, nothing is done to deform the powder particles so as to risk closing of the open pores necessary for easy and thorough infiltration of the impregnating metal.

The resulting compact has a lattice or skeleton form that is substantially stronger than can be obtained by sintering in the absence of the alloying component, this strength being particularly important when the powder particles are of a large grain size for the purpose of providing large open pores. The powder particles are so thoroughly interbonded by their alloyed interconnecting or interbonding portions, that there is substantially no risk that when the material is in service powder particles will loosen or become free, this being of particular importance in the case of vacuum switches where such particles would degrade the electrical isolation desired. A further advantage is that the liquid alloy phase that is developed during sintering, fills micropores which may exist and which are too small to be impregnated during the subsequent impregnation step. The alloy that develops covers each powder particle and forms an active wetting layer for the subsequently infiltrated molten metal impregnant. This wetting advantage is obtained, for example, if the main component of the matrix consists of a metal having a high affinity for oxygen as exemplified by chromium, titanium or zirconium, and the secondary or alloying component forming the liquid phase of the present invention, has a low oxide-forming heat as exemplified by iron, nickel and cobalt.

In connection with the above, it is to be understood that during sintering the molten alloy forms over the entire surface of each powder particle as well as their intercontacting portions which are bonded together by the alloy. The action is not that commonly thought of as liquid-phase sintering because the liquid alloy that forms during sintering is of a relatively minute quantity, leaving the desired open pores between the powder particles for subsequent impregnation. At the same time, the sintering is not effected mainly by interbonding of pure metals under heat and pressure as in conventional sintering.

In the following examples of the practice of the present invention, the grain size of the chromium, zirconium or titanium powders is relatively large and may range up to 150 microns grain size, although the grain size of the alloying component may be smaller since it does not determine the compact pore size; the cold compact molding pressure ranges from 2 to 4 times $10^4$n/cm$^2$, and the compacts are sintered under vacuum.

EXAMPLE 1

From a mixture of chromium powder with 8 percent zirconium expressed here and hereinafter as by weight of the total mixture, a porous compact is molded which is sintered in a vacuum at 1500°C for 1 hour and is subsequently impregnated with CuBi 0.3 or AgBi 0.3 or AgCu10Bi 0.3 or CuTe 0.5 or AgTe 0.5 or AgCu10 Te 0.5. During the sintering process a low-melting alloy forms between Cr and Zr, which is liquid at the sintering temperature of 1500°C and having compositions ranging between ZrCr13 and ZrCr35. The impregnation is advantageously performed in ceramic crucibles at about 1150°C in the csse of CuBi 0.3 or CuTe 0.5, and at about 1050°C in the case of AgBi 0.3 or AgTe 0.5 or AgCu10 Bi0.3 or AgCu10Te0.5. The impregnating atmosphere consists of hydrogen which, after the impregnation is completed, but before the impregnating alloy solidifies, is pumped off again. In order to keep low the Bi or Te loss of the impregnating alloy which occurs here, the ceramic crucibles must be closed by porous, gaspermeable covers, which are impervious to metal vapors. Suitable for this purpose are, for instance, graphite and $Al_2O_3$.

EXAMPLE 2

From a mixture of chromium powder with 6 percent nickel powder, a porous lattice or compact is molded and sintered in a vacuum at 1500°C. At the sintering temperature the nickel phase is liquid and forms melted liquid alloys in the composition range of pure nickel to CrNi36. The impregnating materials and the impregnating method correspond to those in Example 1.

EXAMPLE 3

From a powder mixture of chromium with 4 percent titanium, a porous lattice is molded and sintered in a vacuum at 1500°C. At the sintering temperature a liquid phase forms between Cr and Ti in the composition range of from TiCr27 to TiCr67. The impregnating materials and the impregnating method correspond to those in Example 1.

EXAMPLE 4

From a powder mixture of chromium with 10 percent manganese a porous lattice or compact is pressed and sintered in a vacuum at 1400°C. At the sintering temperature the manganese is present in the liquid phase (melting point 1244°C) and can dissolve at this temperature as a liquid alloy phase 28 percent Cr(MnCr28). The impregnating materials and the impregnating method correspond to those in Example 1.

EXAMPLE 5

From a powder mixture of zirconium with 1 percent nickel, a porous lattice or compact is molded and sintered in a vacuum at 1500°C. At the sintering temperature nickel is present in the liquid phase. The molten range of the ZrNi alloy formed extends 1500°C from pure nickel to ZrNi80 and ZrNi5 to ZrNi45. The two ranges are separated here by the peritectically formed intermetallic phases $ZrNi_3$ and $ZrNi_4$, with melting points above 1600°C. The impregnating materials and the impregnating method correspond to Example 1.

EXAMPLE 6

From a powder mixture of zirconium with 6 percent titanium, a porous lattice is molded and sintered in a vacuum at 1650°C. The zirconium and the titanium format this temperature is a liquid phase in the composition range TiZr35 to TiZr60. The impregnating materials and the impregnating method correspond to Example 1.

EXAMPLE 7

From a powder mixture of zirconium with 1.5 percent manganese a porous lattice is molded and sintered in a vacuum at 1500°C. At the sintering temperature manganese is present in the liquid phase. The molten alloys, or bonding metal, extend from pure manganese to ZrMn10. The impregnating materials and the impregnating method correspond to Example 1.

EXAMPLE 8

From a powder mixture of titanium and 2 percent iron, a porous lattice is molded and sintered in a vacuum at 1400°C. At this temperature liquid phases develop in the composition range FeTi9 to FeTi18 and FeTi40 to FeTi88. The two molten ranges are separated by the intermetallic phase $TiFe_2$, which melts at 1500°C and is formed peritectically. The impregnating materials and the impregnating method correspond to Example 1.

EXAMPLE 9

From a powder mixture of titanium with 3 percent nickel, a porous lattice is molded and sintered in a vacuum at 1400°C. At the sintering temperature the melted liquid range extends from TiNi15 to TiNi95. The impregnating materials and the impregnating method correspond to Example 1.

EXAMPLE 10

From a powder mixture of titanium and 3 percent manganese, a porous lattice is molded and sintered in a vacuum at 1400°C. At the sintering temperature a molten phase can develop in the composition range from TiMn25 to pure manganese. The impregnating materials and the impregnating method correspond to Example 1.

It can be seen from these examples that the minor or secondary component added to the major or primary refractory component, should have a melting temperature higher than that of the impregnating metal and/or that it should form an alloy with the refractory metal having such a higher melting temperature. At the same time, the added component should have a melting temperature lower than the sintering temperature, or should form an alloy with the refractory metal having such a lower melting temperature. The added component should form the strong interbonding between the refractory metal powder particles and, preferably, should also form a layer on these particles, without substantially affecting the latter's refractory characteristics. This may be done by the secondary metal acting alone or via alloying with the major or primary component.

What is claimed is:

1. An electric contact material comprising a sintered metal powder matrix formed by metal powder particles interconnected by interbonding portions and defining pores impregnated with an impregnant material of high electrical conductivity and selected from the class consisting of copper and silver and alloys of copper-silver, copper-bismuth, copper-silver-bismuth, silver-bismuth, copper-tellurium and copper-silver-tellurium; said particles at least mainly consisting essentially of a refractory metal selected from the class consisting of chromium, zirconium and titanium, and said interbonding portions consisting essentially of an alloy of said refractory metal and an alloying metal;

when said refractory metal is chromium said alloying metal being selected from the class consisting of zirconium, iron, nickel, cobalt, titanium and manganese; when said refractory metal is zirconium said alloying metal being selected from the class consisting of chromium, cobalt, iron, nickel, titanium and manganese; and when said refractory metal is titanium said alloying metal being selected from the class consisting of cobalt, iron, nickel and manganese; said alloying metal comprising by weight from 0.2 percent to not more than 15 percent of the total weight of said refractory metal particles and said alloy having a melting temperature higher than that of said impregnant material and being present at least mainly on the surfaces of said particles; said particles of said matrix being substantially free from effects of compression pressure of said matrix during sintering, and said pores being at least mainly open pores and substantially completely impregnated with said impregnant material.

* * * * *